US006856761B2

(12) United States Patent
Doran

(10) Patent No.: US 6,856,761 B2
(45) Date of Patent: Feb. 15, 2005

(54) WALLPAPER REMOVING STEAMERS

(76) Inventor: Kevin Doran, Flat 5, 8 St. Ronans Road, Southsea, Portsmouth (GB), PO4 0PT ( * ) Notice: Subject to any disclaimer, the term of this patent is extended or adjusted under 35 U.S.C. 154(b) by 0 days.

(21) Appl. No.: 10/455,951

(22) Filed: Jun. 6, 2003

(65) Prior Publication Data

US 2004/0247303 A1 Dec. 9, 2004

(51) Int. Cl.[7] ..... D06F 75/20
(52) U.S. Cl. ..... 392/406; 392/394; 392/403
(58) Field of Search ..... 392/394, 403–406; 248/206.2–206.4

(56) References Cited

U.S. PATENT DOCUMENTS

| | | | | | |
|---|---|---|---|---|---|
| 3,997,759 | A | * | 12/1976 | Osrow et al. | 392/404 |
| 4,356,989 | A | | 11/1982 | Ireland | |
| 4,564,188 | A | * | 1/1986 | McNair | 271/103 |
| 4,600,229 | A | * | 7/1986 | Oten | 294/64.1 |
| 5,487,440 | A | * | 1/1996 | Seemann | 180/164 |
| 5,839,532 | A | * | 11/1998 | Yoshiji et al. | 180/164 |
| 6,072,940 | A | | 6/2000 | Doran | |
| 6,090,221 | A | * | 7/2000 | Gan et al. | 134/21 |
| 6,148,144 | A | * | 11/2000 | Milanese | 392/405 |

FOREIGN PATENT DOCUMENTS

| | | | |
|---|---|---|---|
| EP | 0379257 | | 7/1990 |
| GB | 2 336 423 | | 10/1999 |
| GB | 2 370 101 | | 6/2002 |
| JP | 07004022 | * | 1/1995 |
| JP | 07-004022 | | 10/1995 |

* cited by examiner

*Primary Examiner*—Teresa J. Walberg

(57) ABSTRACT

A wallpaper removing steamer is disclosed that comprises a steam applicator assembly mounted on a base for dispensing steam on receipt thereof. Four suction cups are provided at each corner of the base and are adapted to secure the base to a wall papered surface, each suction cup being connected to a vacuum supply. The use of a vacuum supply enables suction cups of a less rigid construction to be employed than those which are mechanically operated. The use of more compliant cups can facilitate self-adjustment of the cups to an uneven wall surface. The cups can be of concertina form and can be provided with an annular, flexible closed-cell foam pad around their mouths to assist in sealing against an irregular surface.

8 Claims, 4 Drawing Sheets

WALLPAPER REMOVING STEAMERS

BACKGROUND OF THE INVENTION

1. Field of the Invention

The present invention relates to wallpaper removing steamers and is concerned with inventive modifications and improvements to the steamer described in my United Kingdom Pat. No. GB 2,336,423 and my U.S. Pat. No. 6,072,940.

2. Description of the Prior Art

The wallpaper remover described in the foregoing patent specifications comprises a base, a steam applicator assembly mounted on the base for dispensing steam upon the receipt thereof, and mounting means coupled to the base for releasably securing the same to a recipient surface. The mounting means includes at least one suction cup, and it was preferred to employ four suction cups at the respective corners of an oblong rectangular base. The suction cups are arranged to be mechanically operated by rotatable levers connected to a common actuator arm.

Such mechanically operated suction cups seal efficiently with smooth planar surfaces. They are commonly employed with panes of glass, for example. However, local areas of wall are often by no means flat, and an effective suction action with all four cups has been found not always to be achieved with the mechanically operated cups.

SUMMARY OF THE INVENTION

According to the present invention a wallpaper remover comprises a base, a steam applicator assembly mounted on the base for dispensing steam on receipt thereof, and at least one suction cup coupled to the base and adapted to secure the base to a wallpapered surface, characterized in that each suction cup being connected to a vacuum supply.

The use of a vacuum supply enables suction cups of a less rigid construction to be employed than those which are mechanically operated. The use of more compliant cups can facilitate self-adjustment of the cups to an uneven wall surface.

Preferably the cups are of concertina form to help pull the steam applicator towards the wallpapered surface through collapsing of the suction cups.

The suction cups are preferably each provided with an annular flexible closed-cell foam pad around their mouths to assist in sealing against an irregular surface.

The vacuum conduits connected to the respective cups are preferably connected to a common vacuum control valve which is preferably mounted on the base.

The suction cups are preferably linked to a manifold block to distribute and substantially equalize the incoming vacuum thereby ensuring each suction cup has a substantially equal vacuum available to it. The manifold block may be a separate unit or formed as part of the base.

The supply conduits to the vacuum cups may be respective passages formed in the base, or they may be respective vacuum tubes mounted on the base and connecting the respective cups with the vacuum control valve. Each conduit may be provided with a filter means to restrict the inward flow of air and debris.

The vacuum control valve preferably comprises a thumb-operable valve actuator mounted on a handle fast with the base, whereby the user whilst holding the handle can operate the valve with his or her thumb.

The housing of the vacuum control valve may be a self-contained housing which is mounted on the base, or it may be an integral part of the base.

A pump, generator or any suitable device generates the vacuum to the unit. The vacuum-generating device generates the vacuum to the unit. The vacuum-generating device may be powered electrically or by air or by any other means. The vacuum-generating device is preferably a separate unit but may be mounted on, in or as part of the base or steam applicator.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

Advantages of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

Two wallpaper steamers in accordance with the invention will now be described, by way of example only, with reference to the accompanying drawings in which.

DESCRIPTION OF PREFERRED EMBODIMENTS

With reference now to the drawings, new wallpaper removing steamers embodying the principles and concepts of the present invention will be described.

Figure 1:
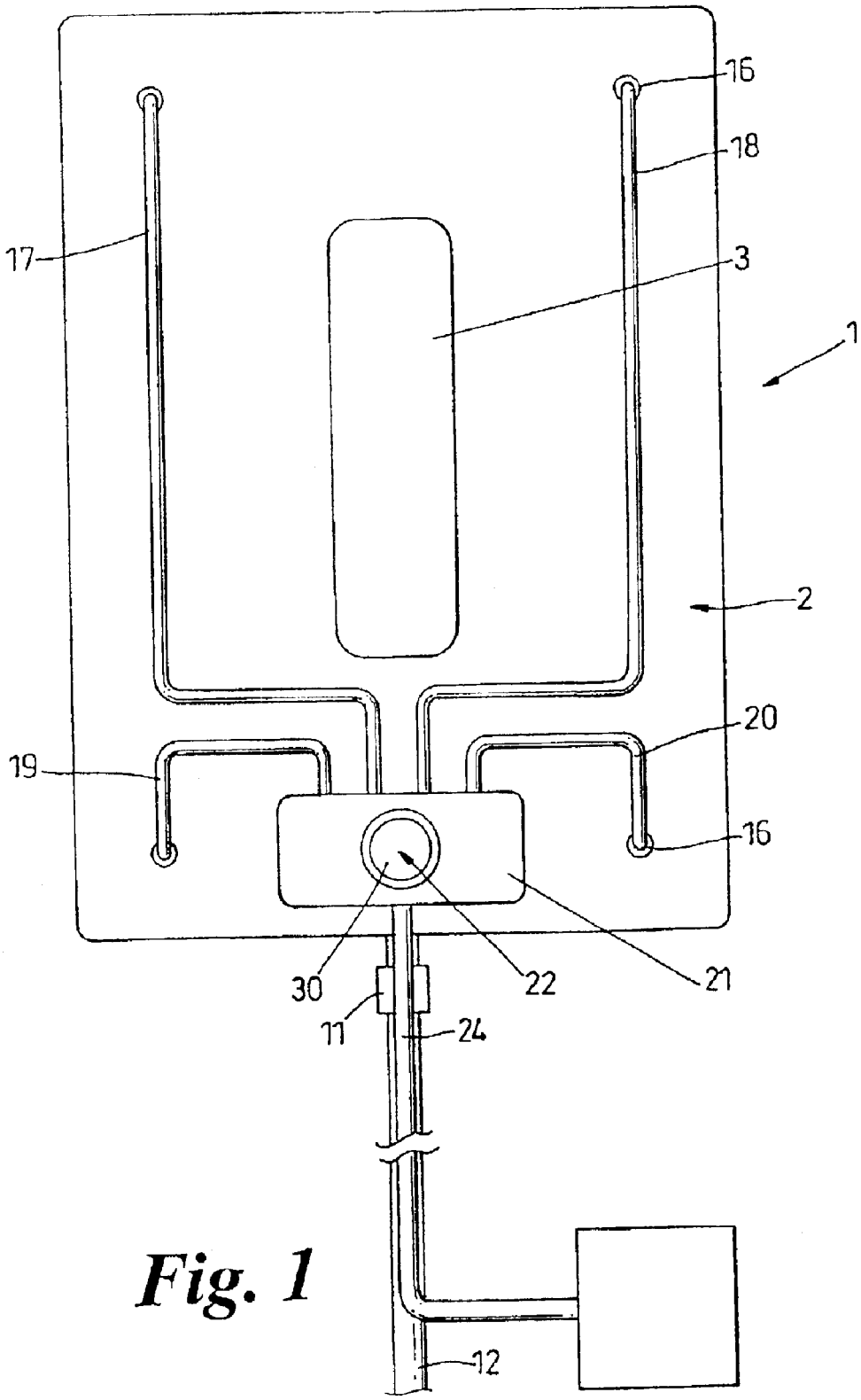
FIG. 1 is a top plan view of a first wallpaper steamer in accordance with the invention shown connected to a remote vacuum pump unit.
Figure 2:
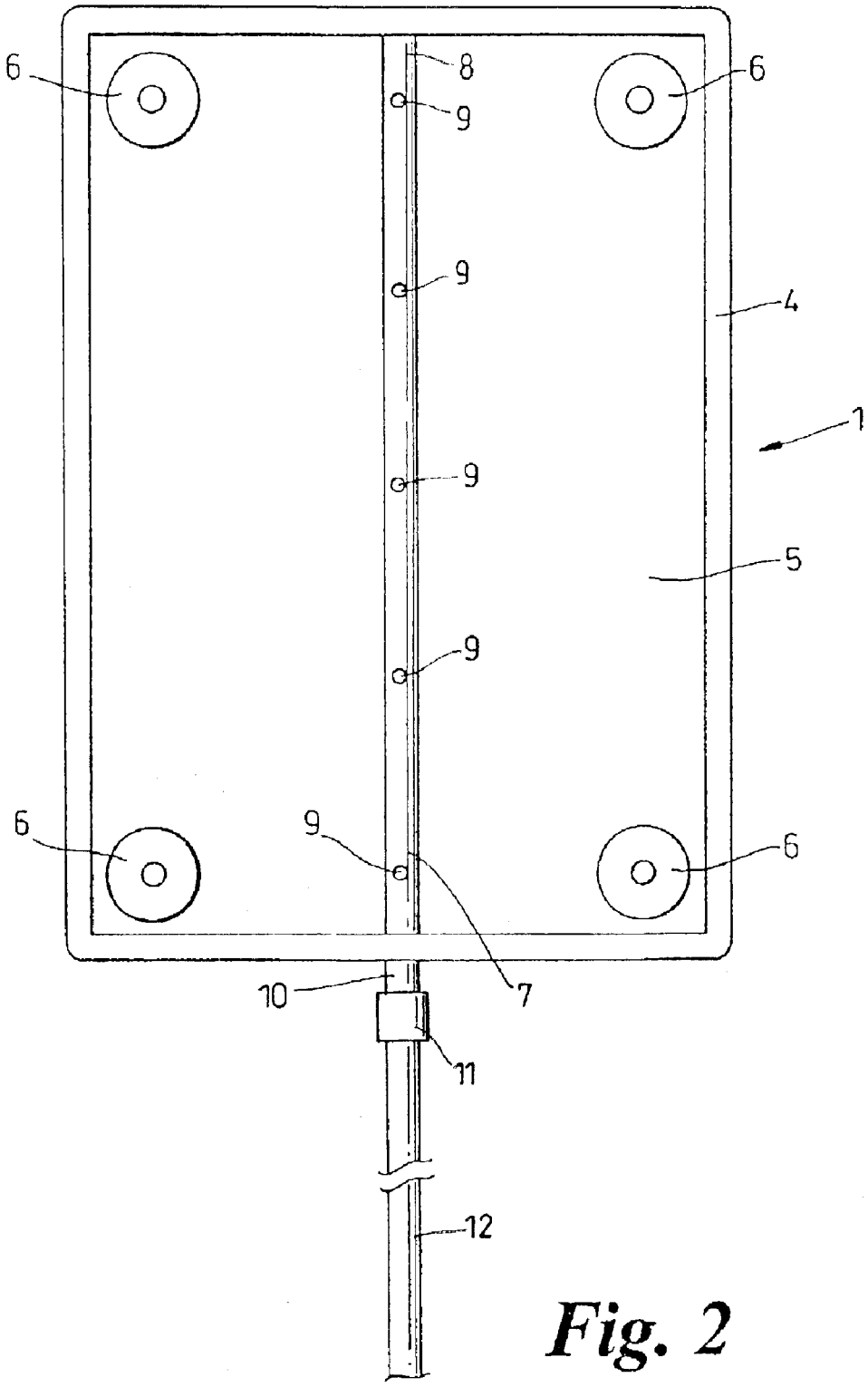
FIG. 2 is a bottom plan view of the steamer of FIG. 1.
Figure 3:
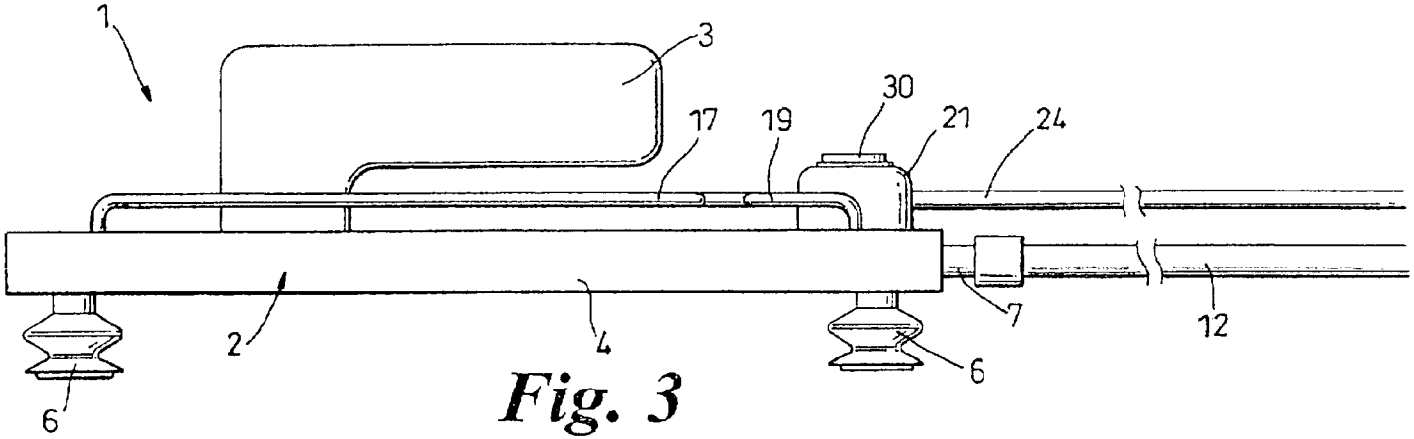
FIG. 3 is a side elevation view of the steamer of FIG. 1.

With particular reference to FIGS. 1 to 3, a wallpaper removing steamer 1 may comprise an oblong-rectangular base plate 2 to the upper surface of which is secured a handle 3. The underside of the base plate 2 may be provided with a shallow recess 5 of uniform depth to define a peripheral skirt 4, and four suction cups 6 may be mounted on the underside adjacent to the respective corners of the base plate 2.

A steam applicator assembly may take the form of a metal steam pipe 7 closed at one end 8 and may be provided with five longitudinally spaced-apart, downwardly directed steam outlet ports 9, the free end 10 of pipe 7 extending through skirt 4 and being coupled at 11 to a flexible steam supply pipe 12.

Figure 5:
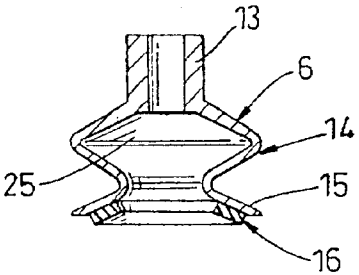
FIG. 5 is a vertical cross-section view of the vacuum sucker of FIG. 4 that may be used with the steamer of FIG. 1.
Figure 4:
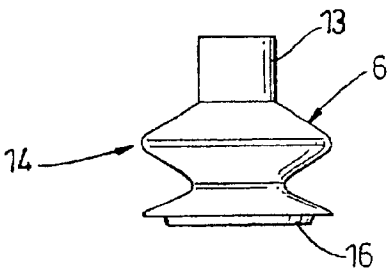
FIG. 4 is a side elevation view of a vacuum sucker used with the steamer of FIG. 1; the sucker being shown in a relaxed, unloaded condition.

As shown in FIGS. 4 and 5, the suction cups 6 each may comprise a tubular attachment boss 13 integral with a concertina bellows portion 14, the outwardly-flared mouth 15 of which may be adhesively bonded to an annular pad 16 of a flexible closed-cell foam material for effecting a good air-tight seal with a wallpapered surface.

Each suction cup 6 may have its boss 13 secured in a respective stepped through-bore 16 in base plate 2, the smaller diameter part of the bores 16 accommodating the remote ends of respective vacuum supply pipe 17, 18, 19, 20 connected to a manifold block 21 mounted on the upper surface of the base plate 4. Pipes 17 to 20 may extend across the upper surface of the base plate 2 and clear of the handle 3.

Manifold block 21, in addition to providing a manifold connection to pipes 17 to 20, may incorporate a vacuum valve unit 22 which is interposed between the manifold and a vacuum supply pipe 24.

The vacuum valve may be arranged in one condition to connect the manifold, and hence the interiors of the four suction cups, with the vacuum supply pipe 24, and in another condition to isolate the vacuum supply pipe 24 and to connect the manifold with atmosphere, thereby to disable the suction force of the cups 6.

The bellows portion 14 of the suction cups may be made of a relatively flexible material to allow the cups 6 to fit against a relatively uneven surface. The resilience of the sealing pads 16, and the flexibility of the bellows portion 14, enable the cups to seal efficiently with a non-flat surface.

Once a sealing pad 16 has engaged with a surface, the pad 16 will be sucked against the surface, to effect a seal between the mouth of the cup and the wallpapered surface, thereby to permit a further reduction in pressure in the cavity 25 defined by the cup. The reduction in pressure in cavity 25 tends to cause the bellows portions 14 of the cups to collapse, thereby pulling the base plate 2 towards the surface. This will cause the steam pipe 7 and skirt 4 to be moved closer to the wallpapered surface, thereby helping to confine the steam to the area of wallpaper beneath the base plate 2.

The flexibility of the suction cups 6 enables an individual cup to seat on a locally uneven surface, but moreover to accommodate different levels of surface as between one cup and another.

It will be appreciated that positioning the actuator button 30 in-line with the handle 3 facilitates thumb operation of the button 30 using the hand that is holding the handle.

Figure 6:
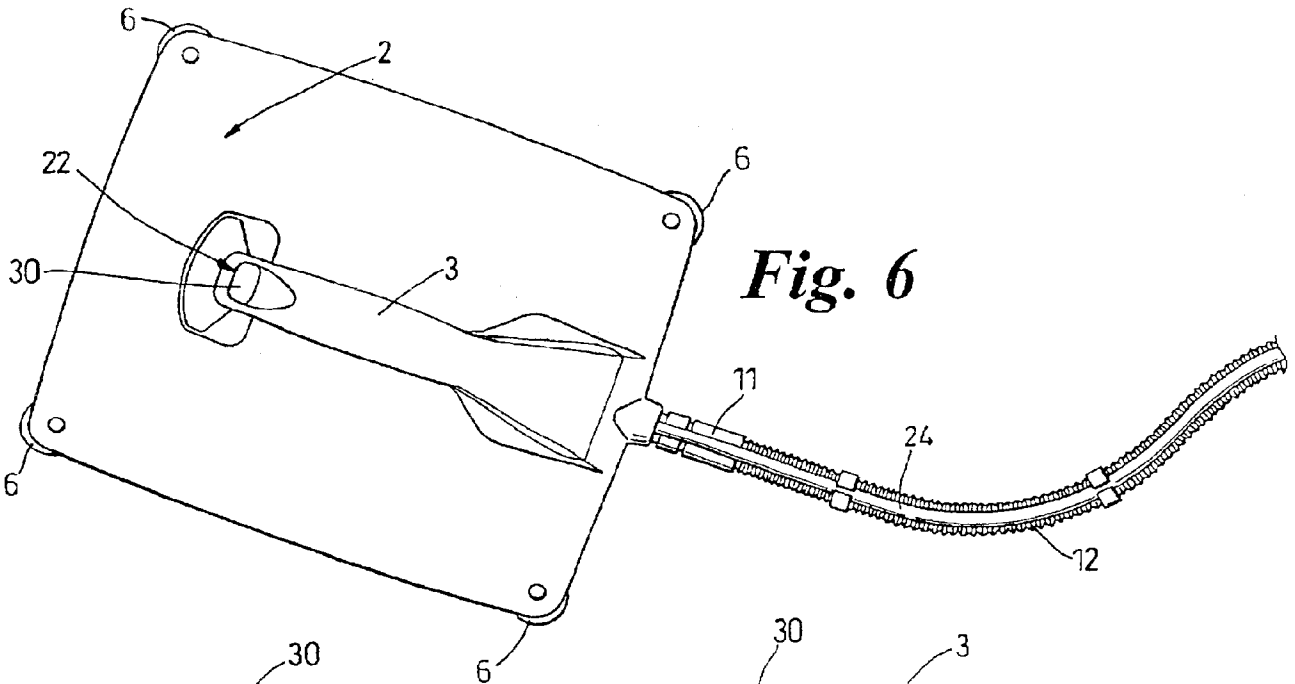
FIG. 6 is a plan view of a second wallpaper steamer in accordance with the invention.
Figure 8:
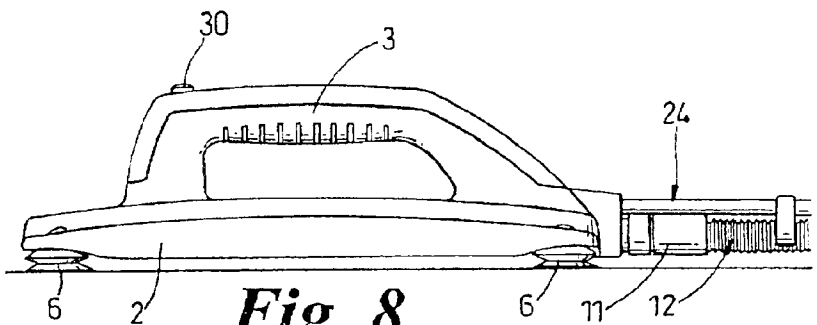
FIG. 8 is a side view of the steamer of FIG. 6 in operation secured by suction to a wallpapered surface.
Figure 7:
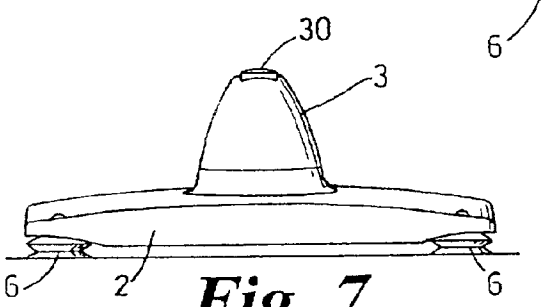
FIG. 7 is a front view of the steamer of FIG. 6 in operation secured by suction to a wallpapered surface.

In FIGS. 6 to 8, parts corresponding to the steamer of FIGS. 1 to 5 have been given corresponding reference numerals. Essentially the main differences between the unit of FIGS. 6 to 8 compared with that of FIGS. 1 to 5 are that, in the second unit, the vacuum supply pipes 17, 18, 19, 20 have been replaced by internal passageways in the base plate 2.

The valve actuator button 30 is positioned towards the opposite end of the base plate 2 from the steam supply pipe 12 and vacuum supply hose 24.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A wallpaper remover comprising a base, a steam applicator assembly mounted on the base for dispensing steam on receipt thereof, and at least one suction cup of concertina form coupled to the base and adapted to secure the base to a wallpapered surface and to pull the steam applicator assembly in use toward the wallpapered surface through a collapsing of the suction cup, each suction cup being connected to a vacuum supply remote from the wallpaper remover.

2. A wallpaper remover as claimed in claim 1 in which there is a plurality of the suction cups.

3. A wallpaper remover as claimed in claim 2 in which the cups are each provided with an annular flexible closed-cell foam pad around their mouths.

4. A wallpaper remover as claimed in claim 2 having vacuum conduits connected to the respective cups, the vacuum conduits being connected to a common vacuum control valve.

5. A wallpaper remover as claimed in claim 4 in which the vacuum control valve is mounted on the base.

6. A wallpaper remover as claimed in claim 4 in which the suction cups are linked to a manifold block to distribute and substantially equalize the incoming vacuum to each suction cup.

7. A wallpaper remover as claimed in claim 4 in which the vacuum control valve comprises a thumb-operable valve actuator mounted on a handle on the base for permitting the user to operate the valve with his or her thumb while holding the handle.

8. A wallpaper remover as claimed in claim 1 wherein there is a plurality of the suction cups;

wherein the cups are each provided with an annular flexible closed-cell foam pad around their mouths;

vacuum conduits being connected to the respective cups, the vacuum conduits being connected to a common vacuum control valve;

wherein the vacuum control valve is mounted on the base;

wherein the suction cups are linked to a manifold block to distribute and substantially equalize the incoming vacuum to each suction cup; and wherein the vacuum control valve comprises a thumb-operable valve actuator mounted on a handle in the base for permitting the user to operate the valve with his or her thumb while holding the handle.

* * * * *